United States Patent [19]

Wolf et al.

[11] 4,059,403

[45] Nov. 22, 1977

[54] PROCESS FOR DYEING WET-SPUN AROMATIC POLYAMIDES IN GEL FORM

[75] Inventors: Gerhard Dieter Wolf; Ralf Miessen; Hans Egon Künzel, all of Dormagen; Francis Bentz, Cologne, all of Germany

[73] Assignee: Bayer Aktiengesellschaft, Leverkusen, Germany

[21] Appl. No.: 602,783

[22] Filed: Aug. 7, 1975

[30] Foreign Application Priority Data

Aug. 10, 1974 Germany ..... 2438544

[51] Int. Cl.[2] ..... D06P 5/00; D06P 3/24

[52] U.S. Cl. ..... 8/168 B; 8/85 R; 8/172 R; 8/171; 28/217; 8/178 A; 28/240

[58] Field of Search ..... 8/168 B, 172, 178 A, 8/172 R; 28/75

[56] References Cited

U.S. PATENT DOCUMENTS

| | | | |
|---|---|---|---|
| 2,558,733 | 7/1951 | Cresswell et al. | 264/182 |
| 3,111,357 | 11/1963 | Wirth et al. | 8/55 |
| 3,233,019 | 2/1966 | Adams | 264/78 |
| 3,242,243 | 3/1966 | Knudson | 264/78 |
| 3,483,576 | 12/1969 | Nakagawa et al. | 8/177 |
| 3,506,990 | 4/1970 | Richardson et al. | 8/172 |
| 3,543,359 | 12/1970 | Whitaker | 28/72.16 |
| 3,602,966 | 9/1971 | Fleissner | 28/1.2 |
| 3,888,821 | 6/1975 | Milford | 260/45.8 NT |

FOREIGN PATENT DOCUMENTS

| | | |
|---|---|---|
| 708,043 | 6/1968 | Belgium |
| 2,000,927 | 7/1971 | Germany |
| 1,494,628 | 4/1971 | Germany |

*Primary Examiner*—Joseph L. Schofer
*Assistant Examiner*—A. L. Clingman
*Attorney, Agent, or Firm*—Plumley and Tyner

[57] ABSTRACT

The invention relates to a process for the production of dyed filaments from aromatic polyamides which contain acid groups.

13 Claims, No Drawings

PROCESS FOR DYEING WET-SPUN AROMATIC POLYAMIDES IN GEL FORM

This invention relates to a process for dyeing fully aromatic polyamides which optionally contain heterocyclic groups and which comprise acidic groups in order to improve their dyeability, with cationic dyes. The process according to the invention essentially comprises wet-spinning solutions of these acid-modified, fully aromatic polyamides optionally containing heterocyclic groups by conventional methods and passing the filaments obtained before, during or after stretching through an aqueous bath containing a cationic dye.

The dyeing of acid modified polyacrylonitrile polymers in "gel form" with water-soluble cationic dyes in an aqueous dye bath has been repeatedly described (U.S. Pat. Nos. 3,113,827; 3,111,357 and 3,242,243; UK patent specification No. 991,957; and German patent specification No. 1,494,628. In order to guarantee a sufficiently deep and washproof dye finish, the acrylonitrile polymers or copolymers are modified with acidic groups, preferably sulphonate groups.

However, it is known among experts that the dyeing of fully aromatic polyamides optionally containing heterocycles has hitherto proved difficult and expensive, even in cases where the polyamides have contained acidic groups in order to improve their dyeability. According to one conventional recipe for dyeing aromatic polyamides, for example poly-m-phenylene isophthalamide, with cationic dyes, the following procedure is adopted:

"The following additions are made to a bath heated to 30° C, which is kept in constant circulation:

40 g/l of benzaldehyde emulsion (the benzaldehyde emulsion is made up of 98 parts of benzaldehyde and 2 parts of non-ionic emulsifier), 20% of sodium chloride (= 20 g/l of sodium chloride for a dye solution ratio of more than 1:20), 0.5% of a standard commercial-grade non-ionic surface-active dispersant, pH 4–4.5 buffered with trisodium phosphate or tetrasodium pyrophosphate.

The dissolved dye is then added and the temperature of the solution is increased over a period of 45 to 60 minutes to the final dyeing temperature required of 120° to 130° C (pressure vessel). Dyeing takes from 1 to 2 hours. The dyeing process is completed by gradual cooling and rinsing.

In order to remove the benzaldehyde from the fibres, the dye finishes obtained have to be subjected to after-treatment under reducing conditions. To this end, the material is treated in a solution containing 2 g/l of conc. hydrosulphite, 0.5 g/l of a standard commercial-grade non-ionic surfaceactive dispersant and trisodium phosphate or tetrasodium pyrophosphate for adjusting a pH-value of from 7 to 8.

The temperature of the treatment bath is 90° to 95° C and the treatment time 10 minutes.

The treatment should be repeated twice after rinsing."

This proven "high-temperature process" for dyeing aromatic polyamides is extremely complicated, time-consuming and expensive.

Accordingly, it was extremely surprising to find that wet-spun filaments of aromatic polyamides optionally containing heterocyclic groups can be given deep, washproof dye finishes in a simple, continuous process. It is particularly remarkable that the quantity of dye taken up by the filaments can be greater than it is in the "high-temperature dyeing process" described above.

It is an object of this invention to provide a simple and continuous process for the production of dyed filaments of aromatic polyamides. Other objects will be evident from the description and the Examples.

These objects are accomplished by a process for the production of dyed filaments of aromatic polyamides which comprises dyeing wet-spun filaments of an aromatic polyamide which optionally contains heterocyclic groups and which contains acidic groups before, during or after stretching in an aqueous bath containing at least one water-soluble, cationic dye.

Fully aromatic or aromatic polyamides or copolyamides which contain aromatic heterocyclic structures and which comprise acidic groups to improve their dyeability with cationic dyes, are already known. Thus, sulphonate groups for example can be introduced by co-condensing sulphoisophthalic acid or its amide-forming derivatives (Belgian Pat. No. 708,043). Aromatic polyamides containing carboxyl groups have also been produced by co-polycondensing diamines containing carboxyl groups (U.S. Pat. Nos. 3,386,965 and 3,380,969). Finally, the introduction of acid groups by the co-condensation of disulphimides containing two amino groups has also been described (German Offenlegungsschrift No. 2,000,927). The quantity of acid groups incorporated may amount to between 50 and 500 mVal per kg of solid polyamide, the range from 80 to 250 mVal/kg being recommended and particularly preferred.

It is possible in this way to modify almost any known fully aromatic or aromatic polyamides or copolyamides containing heterocycles with acid groups to enable them to be dyed with advantage by the process according to the invention. Aromatic modifiable polyamides of this kind are described, for example, in the following Patent Specifications: U.S. Pat. Nos. 2,979,495; 3,006,899; 3,354,127; 3,380,969; and 3,349,061; Netherlands patent specification No. 6,809,916; UK patent specification No. 718,033; and German Offenlegungsschriften Nos. 1,811,411 and 1,946,789.

Most of these aromatic polyamides or copolyamides optionally containing heterocycles are soluble in polar organic solvents, such as N,N-dimethyl formamide, N,N-dimethyl acetamide or N-methyl pyrrolidone, at least in cases where a few per cent of an alkali or alkaline earth salt, such as calcium chloride or lithium chloride, are added as solution promoter, and may readily be spun by the wet-spinning process known per se.

Cationic dyes may be used with particular advantage as the water-soluble dyes. A few dyes are identified by way of example in the following:

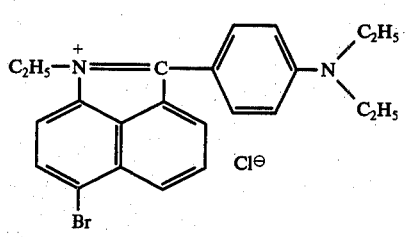

(A)

-continued
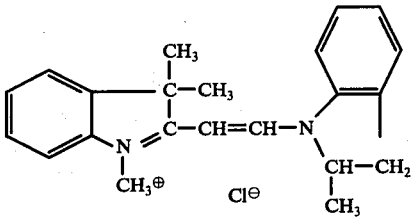
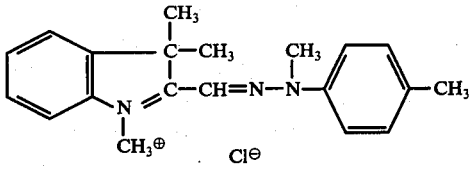
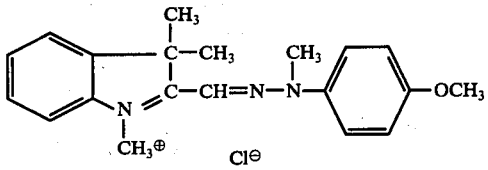
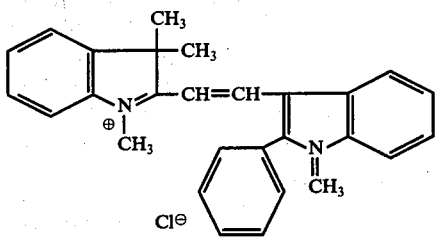
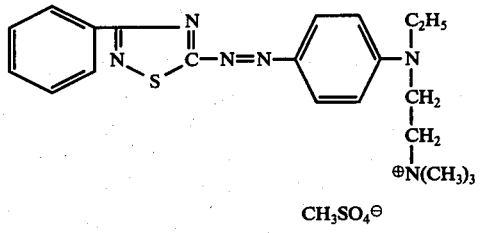
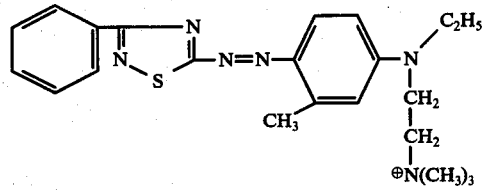
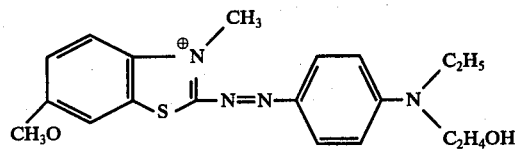
-continued
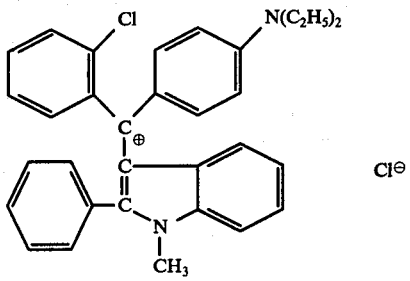
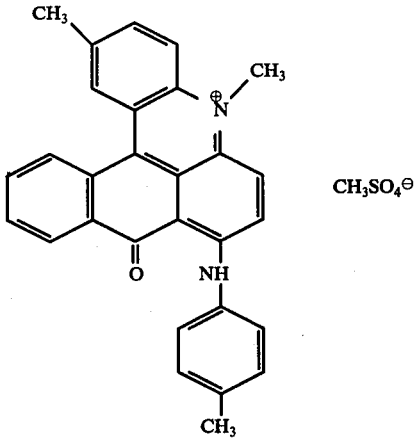
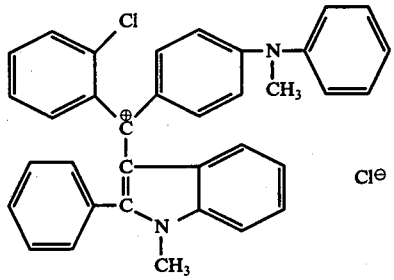
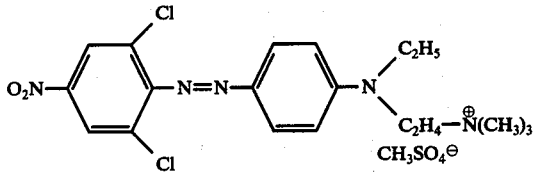
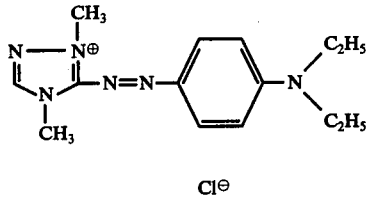
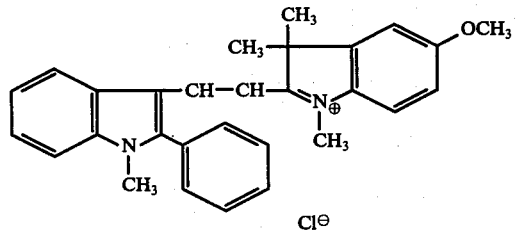
1 : 2 chromium complex of -continued (P)

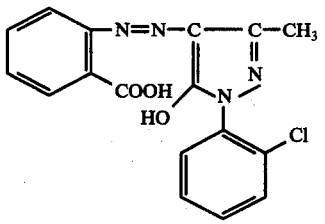

cobalt complex of (Q)

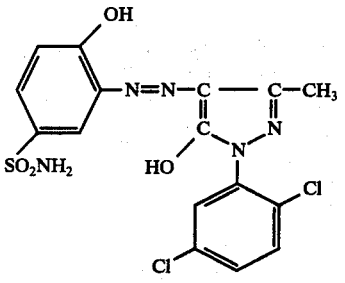

chromium complex of (R)

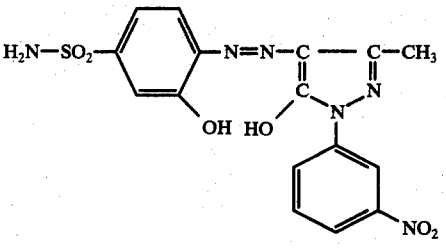

1 : 2 chromium complex of (S)

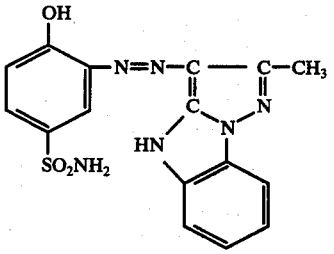

Dyeing of the filaments in the aqueous dye bath is preferably carried out before stretching, although it can also be carried out during or after stretching of the filaments.

The concentration of dye in the dye bath amounts to between 0.01 and 5% and preferably to between 0.2 and 1%. The temperature of the dye bath may be in the range from 20° to 100° C, although it is preferably kept at 50° to 80° C.

In one preferred embodiment, from 1 to 40% by weight and preferably from 10 to 25% by weight (based on the total weight of the bath) of a polar organic solvent, for example dimethyl acetamide, N-methyl pyrrolidone, dimethyl formamide or hexamethyl phosphoric acid tris amide, is added to the aqueous dye bath. It is preferred to use the same solvent as is used for preparing the spinning solution.

More particularly, the process is carried out as follows:

The polycondensation and the preparation of suitable spinning solutions of the polyamides are adequately described in the above-mentioned Patent Specifications. The polyamides used in this process are aromatic polyamides which contain comonomers with acid groups in co-condensed form. The acid groups are preferably the sulphonate and the disulphimide group. The quantity of acid groups incorporated should be in the range from 50 to 500 mVal and preferably in the range from 80 to 250 mVal per kg of solid polyamide.

Spinning is carried out by the wet-spinning process known per se in which individual spinning conditions may be varied within wide limits. It is advantageous to use spinning solutions with viscosities in the range from 300 to 1100 poises at 20° C and with a solid polyamide concentration, corresponding to those viscosities, of from about 13 to 25% by weight. The spinnerets used are 20–1000-bore spinnerets with a bore diameter of from 0.08 to 0.2 mm. The aqueous precipitation bath contains from 40 to 65% by weight (based on the total weight of the bath) of a polar organic solvent (preferably the spinning solvent) and is adjusted to a temperature of from 20° to 50° C. The take-off rate is with advantage from 4 to 8 meters per minute.

The coagulated filaments are introduced into the aqueous dye bath containing from 0.01% to 5% by weight and preferably from 0.2% to 1% by weight (based on the bath) of a cationic dye in dissolved form, either after washing in a water bath or directly, i.e. without washing. The bath is kept at a temperature of from 20° to 100° C and preferably at a temperature of from 50° to 80° C. The average residence time of the filaments is from 10 to 30 seconds. In one preferred embodiment of this process, the dye bath additionally contains from 1 to 40% by weight and preferably from 10 to 30% by weight (based on the total weight of the bath) of a polar organic solvent such as N-methyl pyrrolidone, dimethyl acetamide, dimethyl formamide or hexamethyl phosphoric acid tris-amide, but preferably the spinning solvent.

The filaments are then passed through an aqueous washing bath with a temperature in the range from 20° to 80° C. The residence times in the washing bath are preferably from 10 to 60 seconds, although residence times of up to 5 minutes are also possible. After it has passed through the washing bath, the filament has a solvent content of less than 3%.

The aftertreatment of the precipitated and washed filaments is governed by the chemical structure of the filaments and is described in the Patent Specifications quoted above. In general, it is best to subject the filaments to a two-stage stretching process, in which they are initially stretched in boiling water in a ratio of 1:1.2 to 2.2, followed by stretching on a curved heating surface or on a godet at a temperature in the range from 200° to 360° C, the stretching ratio in this second stage of the stretching process being from 1:2.0 to 8.0. The stage filaments thus obtained show the favourable textile properties which are specific to them and which are described in the Patent literature. In addition, they are given deep, washproof dye finishes by a simple, continuous process. Comparison of this gel-phase dyeing process with the conventional "high-temperature dyeing" process surprisingly shows that dyeing in the gel phase produces a deeper dye finish.

The following Examples are to further illustrate the invention without limiting it.

EXAMPLE 1

Preparation and dyeing of filaments of an acid-modified polyamide essentially comprising structural units corresponding to the formula

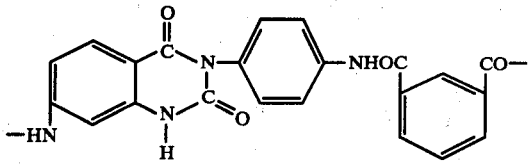

with a blue dye of constitution (A).

a. Preparation of the polyamide 153 parts by weight of 3-(p-aminophenyl)-7-amino-2,4-(1H,3H)-quinazolindione at 10.8 parts by weight of sodium di-(m-aminophenyl)-disulphimide were introduced into 860 parts by weight of absolute dimethyl acetamide. 122 parts by weight of isophthalic acid dichloride were added in portions with continuous stirring at a temperature of 5° to 10° C, and the viscous solution stirred at room temperature for about another 12 hours. In the meantime, another 440 parts by weight of dimethyl acetamide had to be added in order to adjust the viscosity to a value in the range from 2000 to 3000 poises. The hydrochloric acid formed during the polycondensation reaction was arrested with equivalent quantities of propylene oxide.

b. Production and dyeing of the filaments

This spinning solution with a viscosity of 2850 poises at 20° C ($\eta_{rel}$ = 2.3, as measured on a 0.5% solution in N-methyl pyrrolidone at 20° C) was spun through a 10-bore spinneret (bore diameter 0.1 mm) into a precipitation bath (bath temperature 20° C) consisting of 70 parts by weight of water and 30 parts by weight of dimethyl acetamide. The take-off rate of the filaments was 5 meters per minute. The filaments were then washed briefly in a water bath and introduced into a dye bath which contained 10 g/l of dye (A). The residence time in the dye bath was 14 seconds. The dyed filaments were then washed in boiling water and at the same time stretched in a ratio of 1:1.5. Final stretching was carried out after drying on a circular heating surface 30 cm long at a temperature of 300° C, the stretching ratio being 1:1.4. The filament yarn was found to show the following textile properties:

tensile strength : 3.2 - 3.5 g/dtex elongation : 6 - 10%

The dye finish applied to the filaments were deep and washproof.

EXAMPLE 2

The procedure was the same as described in Example 1, except that 20% by weight (based on the total weight of the bath) of dimethyl acetamide were additionally added to the aqueous dye bath. In other respects, the procedure was exactly the same as in Example 1. The filaments obtained had virtually the same textile properties, but were dyed. slightly deeper.

EXAMPLE 3

Production and dyeing of filaments of an acid-modified polyamide essentially containing structural units corresponding to the formula

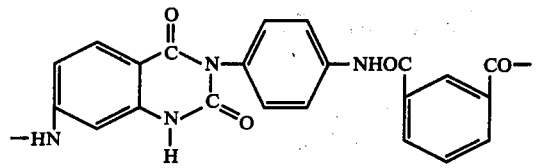

with a yellow dye of constitution (P).

a. Preparation of the polyamide 134 parts by weight of 3-(p-aminophenyl)-7-amino-2,4-(1H,3H)-quinazolindione and 16.7 parts by weight of sodium di-(4-chloro-3-aminophenyl)-disulphimide were introduced into 780 parts by weight of absolute dimethyl acetamide, followed by the introduction in portions with continuous stirring at 5° to 10° C of 109.5 parts by weight of isophthalic acid dichloride, after which the viscous solution was stirred at room temperature for about another 12 hours. The hydrochloric acid formed during the polycondensation reaction was arrested with 62 parts by weight of propylene oxide.

b. Production and dyeing of the filaments

Filaments were spun from this polyamide solution, which had a viscosity of 1500 poises ($\eta_{rel}$ = 2.0 as measured on a 0.5% solution of the polyamide in N-methyl pyrrolidone at 20° C), through a 10-bore spinneret into an aqueous precipitation bath. The take-off rate amounted to 5 meters per minute. The filaments were then passed into an aqueous dye bath which contained approximately 20% by weight of dimethyl acetamide and 10 g/l of dye (P). After a residence time of about 14 seconds in the dye bath, the filaments were washed in boiling water and at the same time initially stretched in a ratio of 1:1.4. Final stretching was carried out after drying on a curved heating surface at 320° C, the stretching ratio being 1:1.4.

tensile strength : 3.5 - 3.9 g/dtex elongation : approximately 10%.

The dye finish was deep and washproof.

EXAMPLE 4

Production and dyeing of filaments of an acid-modified poly-m-phenylene isophthalamide with a red dye of constitution (N).

a. Production of the polyamide 203 parts by weight of isophthalic acid dichloride were added at −20° C to 104.8 parts by weight of m-phenylene diamine and 10.5 parts by weight of sodium di-(aminophenyl)-disulphimide in 820 parts by weight of absolute dimethyl acetamide. The solution which quickly became viscous had another 2 parts by weight of isophthalic acid dichloride added to it after half an hour. The hydrochloric acid formed during the polycondensation reaction was neutralised with 20 parts by weight of $CaCO_3$ and 93 parts by weight of propylene oxide.

b. Production and dyeing of the filaments

This spinning solution, which had a viscosity of 1390 poises at 20° C ($\eta_{rel}$ = 1.96, as measured on a 0.5% solution in N-methyl pyrrolidone at 20° C) was spun through a 50-bore spinneret with a bore diameter of 0.1 mm into a dye bath (bath temperature 20° C) consisting of 90 parts by weight of water and 10 parts by weight of dimethyl acetamide. The take-off rate of the filaments amounted to 5 meters per minutes. After brief washing in a water bath, the filaments were passed into a dye bath containing 10 g/l of dye (N). The dye bath additionally contained 10% of dimethyl acetamide. The bath temperature was 20° C. After a residence time of approximately 15 seconds in the dye bath, the filaments were introduced into a boiling water bath in which they were washed and at the same time stretched in a ratio of 1:1.7. Final stretching was carried out after drying on a curved heating surface at a temperature of 310° C, the stretching ratio being 1:2.5.

tensile strength : 3.4 – 3.8 g/dtex elongation : 25%

The filaments had a deep red, washproof dye finish.

EXAMPLE 5

When the aqueous dye bath was kept at 80° C during the dyeing process, the procedure being otherwise exactly the same as in Example 4, the filaments obtained had substantially the same textile properties, but a slightly deeper dye finish.

EXAMPLE 6

Production and dyeing of filaments of an acid-modified polyamide essentially containing structural units corresponding to the formula

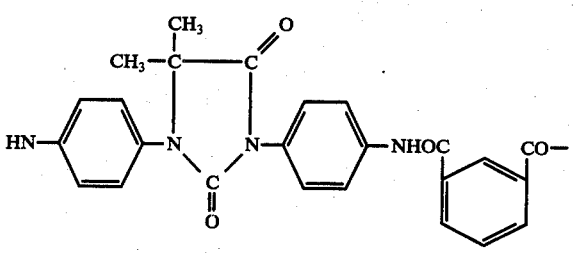

with an orange dye of constitution (O).

a. Production of the polyamide 155 parts by weight of 1,3-bis-(p-aminophenyl)-5,5-dimethyl-hydantoin and 22.2 parts by weight of sodium 4-chloro-3-aminophenyl-3′-aminophenyl disulphimide were dissolved in 870 parts by weight of absolute N-methyl pyrrolidone, followed by the addition in small portions at 50° to 10° C of 111.6 parts by weight of isophthaloyl chloride. The viscous solution was stirred at room temperature for about another 12 hours. The hydrochloric acid formed during the polycondensation reaction was arrested with equivalent quantities of propylene oxide.

b. Production and dyeing of the filaments

This highly viscous solution, $\eta = 2750$ poises, $\eta_{rel} = 1.75$ (as measured on a 0.5% solution of the polyamide in N-methyl pyrrolidone at 20° C) was spun by the wet-spinning process. The filaments were run off at 5 meters per minute from a 50-bore spinneret (bore diameter 0.1 mm). Water at 20° C containing 20% of N-methyl pyrrolidone was used as the precipitation bath. The filaments were then introduced into a dye bath containing 10 g/l of dye (O), bath temperature 50° C. The residence time in the dye bath amounted to 14 seconds. The dyed filaments were initially stretched in boiling water in a ratio of 1:1.5, dried and then stretched to completion on a curved heating surface at 330° C in a ratio of 1:1.5.

tensile strength : 2.8 – 3.2 g/dtex elongation : 10%

The dye-finish on the filaments was deep and washproof.

EXAMPLE 7

The viscous solution described in Example 6 was spun in the same way as described in that Example. The filaments were then initially stretched in a ratio of 1:1.5 during the dyeing process in a dye bath which contained 10 g/l of dye (O) and which had a temperature of 95° C.

After the standard aftertreatment, the filaments obtained were not dyed quite so deeply as the filaments described in Example 6. The textile properties of the filaments were substantially the same.

What we claim is:

1. A process for the production of dyed filaments of aromatic polyamides which comprises continuously dyeing wet-spun gel filaments of an aromatic polyamide which contains acidic groups before, during, or after stretching, in an aqueous bath containing at least one water-soluble, cationic dye in dissolved form.

2. The process of claim 1 wherein the aromatic polyamide further contains heterocyclic groups.

3. The process of claim 1, wherein said polyamide contains from 50 to 500 mVal of acid groups per kg of solid polyamide.

4. The process of claim 1, wherein said polyamide contains from 80 to 250 mVal of acid groups per kg of solid polyamide.

5. The process of claim 1, wherein said filament is first dyed and subsequently stretched.

6. The process of claim 1, wherein said filament is prestretched during dyeing in said aqueous dye bath.

7. The process of claim 1, wherein said aqueous dye bath contains from 0.01 to 5% by weight of said water-soluble dye in dissolved form.

8. The process of claim 1, wherein said aqueous dye bath has a temperature of from 20° to 100° C.

9. The process of claim 1, wherein said aqueous dye bath additionally contains from 1 to 40% by weight, based on the total weight of the bath, of a polar organic solvent.

10. The process of claim 9, wherein said polar organic solvent is a member selected from the group consisting of dimethyl acetamide, N-methyl pyrrolidone, dimethyl formamide and hexamethyl phosphoric acid tris amide.

11. The process of claim 1, wherein said polyamide is an acid-modified poly-m-phenylene isophthalamide.

12. The process of claim 1, wherein said polyamide is an acid-modified heterocyclic polyamide corresponding to the formula

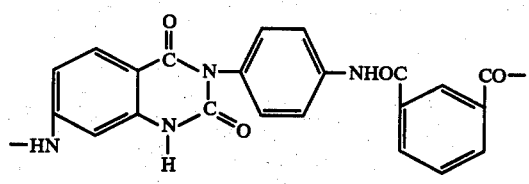

13. The process of claim 1, wherein said polyamide is modified by co-condensation with a comonomer containing sulphonate groups or disulphimide groups.

* * * * *